United States Patent [19]

Benelli

[11] Patent Number: 4,856,217

[45] Date of Patent: Aug. 15, 1989

[54] CARTRIDGE FEEDING ASSEMBLY FOR SMOOTH-BORE GUNS WITH SEMIAUTOMATIC OR PUMP OPERATION

[75] Inventor: Paolo Benelli, Pesaro, Italy

[73] Assignee: Benelli Armi S.p.A., Urbino, Italy

[21] Appl. No.: 157,844

[22] Filed: Feb. 19, 1988

[30] Foreign Application Priority Data

Mar. 12, 1987 [IT] Italy ..... 44099 A/87

[51] Int. Cl.[4] ..... F41C 13/00

[52] U.S. Cl. ..... 42/17

[58] Field of Search ..... 42/17, 21

[56] References Cited

U.S. PATENT DOCUMENTS

| | | | |
|---|---|---|---|
| 984,489 | 2/1911 | Redfield | 42/21 |
| 984,490 | 2/1911 | Redfield | 42/21 |
| 2,562,037 | 7/1951 | Humeston | 42/17 |
| 3,201,886 | 8/1965 | Kelly et al. . | |
| 4,014,247 | 3/1977 | Tollinger . | |
| 4,601,122 | 7/1986 | Beretta | 42/21 |

*Primary Examiner*—Deborah L. Kyle
*Assistant Examiner*—Richard W. Wendtland
*Attorney, Agent, or Firm*—Amster, Rothstein & Ebenstein

[57] ABSTRACT

The present invention relates to smooth-bore guns having a tubular magazine and an operating system either semiautomatic indifferently of the inertial type, of the gas intake type or of the recoiling barrel type, or manual pump-operated or convertible from one system to the other, relating essentially to a new cartridge feed system adapted to these types of firearms.

The invention comprises a new cartridge descent lever which, causes the cartridges to pass from the magazine tube into the barrel, either automatically or manually.

For the feeding with semiautomatic operation of the firearm, part of the energy of the spring of the hammer of the firearm is used to cause the vertical rotation of the cartridge descent lever so that a cartridge exits from the magazine tube.

For the feeding with manual pump operation of the firearm, the same movement is caused by the bolt when it opens manually, by means of the cocking rod, for the expulsion of the case in the barrel.

Finally, for the manual change of the cartridge in the barrel, the same movement can be caused by the hand of the shooter which, with the finger which presses the trigger, finds, in an easily accessible position, a tab of the cartridge descent lever protruding from the lower level of the body of the firearm.

In all the cases described above, the successive passage in the barrel of the cartridge, exiting from the magazine tube, occurs in a conventional manner for the type of firearm considered.

In the various operating systems all the movements of the new cartridge descent lever are in any case synchronized and compatible with the used operation without the need for adjustments.

The new cartridge feed system allows, in an entirely simple and original manner, the use of the same parts on a gun with automatic operation, on a gun with manual (pump) operation and on a gun convertible from semiautomatic to pump operation.

Considerable economic advantages, extreme versatility of models, a substantial reduction of the overall number of components, and an improved reliability in use are achieved thereby.

7 Claims, 5 Drawing Sheets

1
2
3
4
5
6
7
8
9
10
11
12
13
14
15
16
38
44
45

22
12
28
21
1
2
18
24
23
19
20
30
11
10
25
26
29
5
17
16
14
15
13
27

12
37
22
1
36
23
18
3
31
8
6
16
35
11
15
10
2
24
20
19
4
5

16
14
35
32
33
13
11
12
34
10
15
27
24

15
30
36
41
40
39
31
16
35
1
2
34
15
29
16
35
12
11
30

12
1
36
42
2
31
30
11
10
43
37
30
11
14
13
12
27
28
29

CARTRIDGE FEEDING ASSEMBLY FOR SMOOTH-BORE GUNS WITH SEMIAUTOMATIC OR PUMP OPERATION

BACKGROUND OF THE INVENTION

A gun with smooth-bore barrle, whatever its operating system, necessarily has feed (recocking) assemblies such as to cause, at every fired round, the passage of a new cartridge from the magazine, generally tubular in shape, into the cartridge chamber of the barrel.

If this passage occurs automatically at each fired round, the gun will be termed semiautomatic in operation; if the passage occurs, at each fired round, manually, by means of the movement of the cocking rod, the gun will be termed manually or pump operated.

In order to achieve, in either case, the passage of the cartridge from the magazine to the cartridge chamber of the barrel, the backward opening stroke of the bolt assembly has always been used, in various manners, to synchronize the movements of the lever (or levers) for stopping the cartridge in the magazine, for the exit of a single cartridge at a ttime, with those of a lifter cup on which said cartridge is arranged, in exiting from the magazine, to be raised to a position suitable for introduction into the barrel.

Various feed systems are known, suitable for the type of operation (semiautotmatic or pump) with which the firearm is provided, generally comprising two levers for stopping the cartridge in the magazine and shaped so as to be moved by the bolt of the firearm, or even partly arranged directly on said bolt.

In all these cases, suitable buttons, mounted separately, prepare the firearm, in a more or less complicated manner, for the manual passage of the cartridge in the barrel from the magazine or for the momentary locking of the cartridges in the magazines for changing the one in the barrel.

These systems are extremely complex and expensive and are generally used only on firearms with pump operation.

Simpler feed systems are also known, having a single cartridge stop lever, developed with the onset of the semiautomatic operating system of the firearm, but, mostly, are only operable with this operating system and do not allow the manual passage of the cartridges from the magazine to the cartridge chamber of the barrel of said firearm, unless highly complicated and delicate mechanims are used.

SUMMARY OF THE INVENTION

The object of this invention is to overcome the limitations and the complexity of systems hitherto known by providing a new feed assembly applicable to guns with different types of operation (semiautomatic, manual pump and combined: semiautomatic/pump) and capable of selecting, in a simple and safe manner, the exit of the cartridges from the magazine independently from the operating system of the firearm and without the need for preventive manual presetting.

The invention achieves the above and other objects, such as will appear from the following disclosure, by means of a cartridge feeding assembly for delivering cartridges from a tubular magazine into the barrel of a smooth-bore firearm having a casing, a bolt slidable with respect to the casing, a lifter cup for the cartridge, a hammer and a trigger, the feeding assembly further comprising:

(a) a cartridge descent lever pivoted on the casing, and having a first leg directed toward the cartridge magazine and having a nose, and an integral second leg directed away from the magazine;

(b) a spring mounted on the casing and normally biasing the cartridge descent lever to a rest position its nose is lifted, the lever being swung away from its rest position where by the hammer during shooting;

(c) a cartridge stop lever pivoted on the casing and having a nose interacting with the nose of the cartridge descent lever so that the cartridge stop lever retains a cartridge in the magazine while the cartridge descent lever is in its rest position and allows the cartridge to slide out of the magazine when the cartridge descent lever swings from its rest position.

BRIEF DESCRIPTION OF THE DRAWINGS

The invention will become apparent from the following detailed description of a preferred embodiment thereof, as installed in a rifle of which all the parts operating in a conventional manner are omitted. The preferred embodiment will be described with reference to the accompanying drawings, wherein.

DESCRIPTION OF THE PREFERRED EMBODIMENTS

Figures 1, 2:
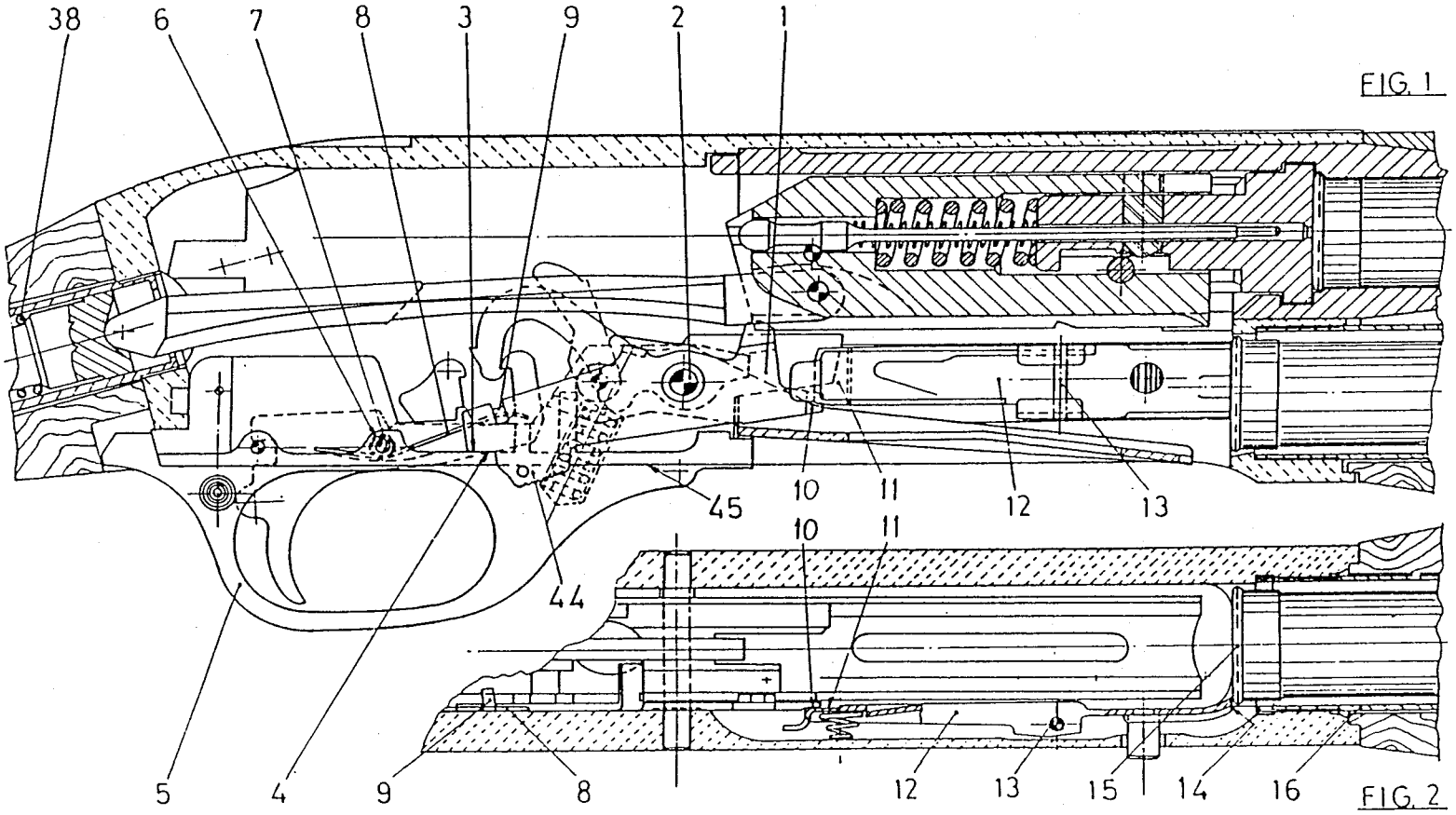
FIG. 1 is a fragmentary axial cross section of the firearm ready to fire and having: bolt in closure position, cocked hammer, loaded tubular magazine and feed assembly in a condition to prevent the exit of the cartridges from the magazine.
FIG. 2 is a fragmentary transverse cross section view of the firearm in the same conditions described above.

With reference to FIG. 1, a fragmentarily illustrated rifle comprises a casing 33, a magazine 16, a trigger 17 protected by a guard 5, and a hammer 18.

The feed assembly according to the invention substantially comprises a cartridge descent lever 1, pivoted to the firearm on a pivot 2 and held in resting position, with its resting plane 3 against the abutment plane 4 provided on the guard 5, by a spring 6 pivoted on a pivot 7. Spring 6 rests with its stem 8 on a tab 9 of the cartridge descent lever 1, and it exerts upon the tab a downward force so as to ensure the contact between the above described planes 3 and 4.

In this position (see also FIG. 2) the outer part of the flat 11 of the cartridge stop lever 12 rests on the flat 10 of the cartridge descent lever 1, and is pivoted to the firearm at the pivot 13 and conveniently preset in such a manner that, in this position, the front plane 14 of said cartridge stop lever 12 prevents the cartridge 15 from leaving the inside of the magazine tube 16.

When trigger 17 of the firearm is pulled (FIG. 3), a hammer 18 is pushed by a spring 19 guided on a sliding bush 20, and turns about its pivot 2 until it imparts to the firing pin 21 an energy sufficient to cause the explosion of the cartridge in the barrel 22.

Simultaneously to this percussion action, the front plane 23 of the sliding bush 20 strikes on a tab 24 of the cartridge descent lever 1 causing the clockwise rotation of the latter until the plane 25 of said cartridge descent lever abuts with plane 26 provided on the guard 5.

This rotational movement (FIGS. 3-4), prevents the flat 10 of the cartridge descent lever 1 from acting as rest for the flat 11 of the cartridge stop lever 12. The cartridge stop lever 12 no longer rests on the cartridge descent lever 1, and rotates about its fulcrum 13 as an effect of the return spring 27 until its flat 28 rests on the side 29 of lifting cup 30.

As a consequence of this rotation (FIG. 4), the front plane 14 of the cartridge stop lever 12 no longer prevents the cartridge 15 from sliding out of the magazine tube 16.

Figures 5, 6:
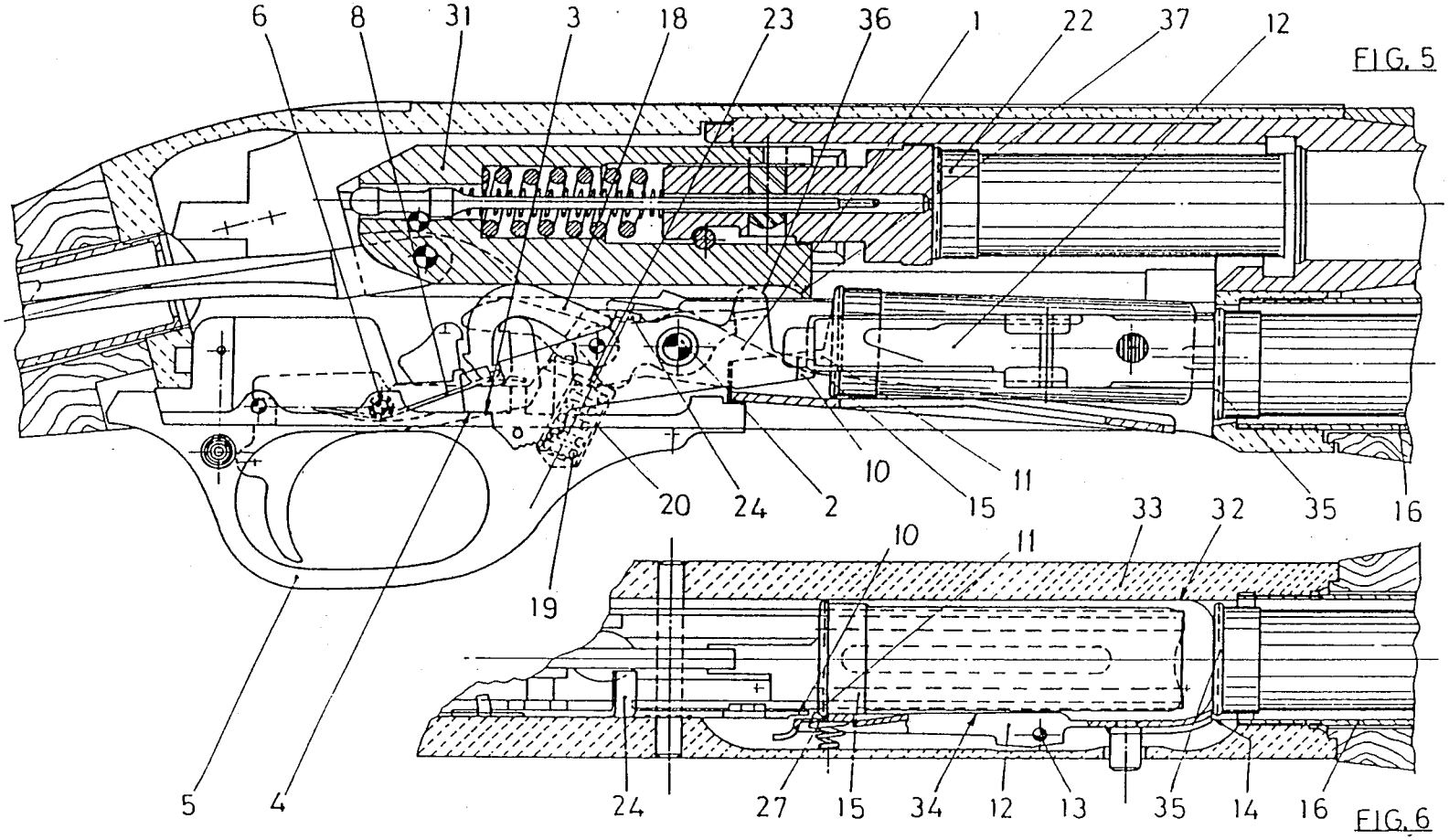
FIG. 5 is a fragmentary axial sectional view of the firearm in a stage subsequent to the percussion of the cartridge in the barrel with the bolt in opening movement which is recocking the hammer and the feed assembly which has allowed the complete exit of a single cartridge from the magazine.
FIG. 6 is a fragmentary transverse sectional view of the firearm in the same conditions described for FIG. 5.

While the bolt 31 starts it backward opening stroke (FIG. 5), thus pulling the cartridge case 22 from the cartridge chamber of the firearm in a conventional manner with respect to the type of operation of the firearm (inertial closure, gas intake, recoiling barrel, etc.), the cartridge 15 is already completely out of the magazine tube.

The cartridge 15 leaving the magazine tube 16 is forced (FIG. 6) by the plane 32 of the casing 33 to slide along the plane 34 of the cartridge stop lever 12. This movement causes the cartridge stop lever 12 to turn anticlockwise on its pivot 13, thus recompressing the return spring 27 until it returns to the position of FIG. 2, i.e. with its front plane 14 in a position preventing the second cartridge 35 in the magazine from leaving the magazine 16.

While the bolt 31 continues its backward stroke (FIG. 5), the hammer 18 is recocked and its sprg 19, guided on the sliding bush 20, is recompressed to a cocking position.

The plane 3 of the sliding bush 20 no longer pushes against the tab 24 of the cartridge descent lever 1. As an effect of the thrust of the stem 8 of return spring 6, the descent lever 1 rotates on the pivot 2 until it returns to its rest position determined by the resting plane 3 on the abutment plane 4 of the guard 5.

In this condition, the flat 10 of the cartridge descent lever 1 already overlaps the flat 11 of the cartridge stop lever 12. These flats, however, are not (FIG. 6) in mutual contact as in FIG. 2, since the cartridge 15 forces the flat 11 of the cartridge stop lever 12 to stay slightly ajar from the flat 10 of the cartridge descent lever 1.

In other words, it is the cartridge 15 leaving the magazine tube 16 that, by holding the front plane 14 of the cartridge stop lever 12 against the bottom of the second cartridge 35 in the magazine, momentarily prevents its exit.

Figures 3, 4:
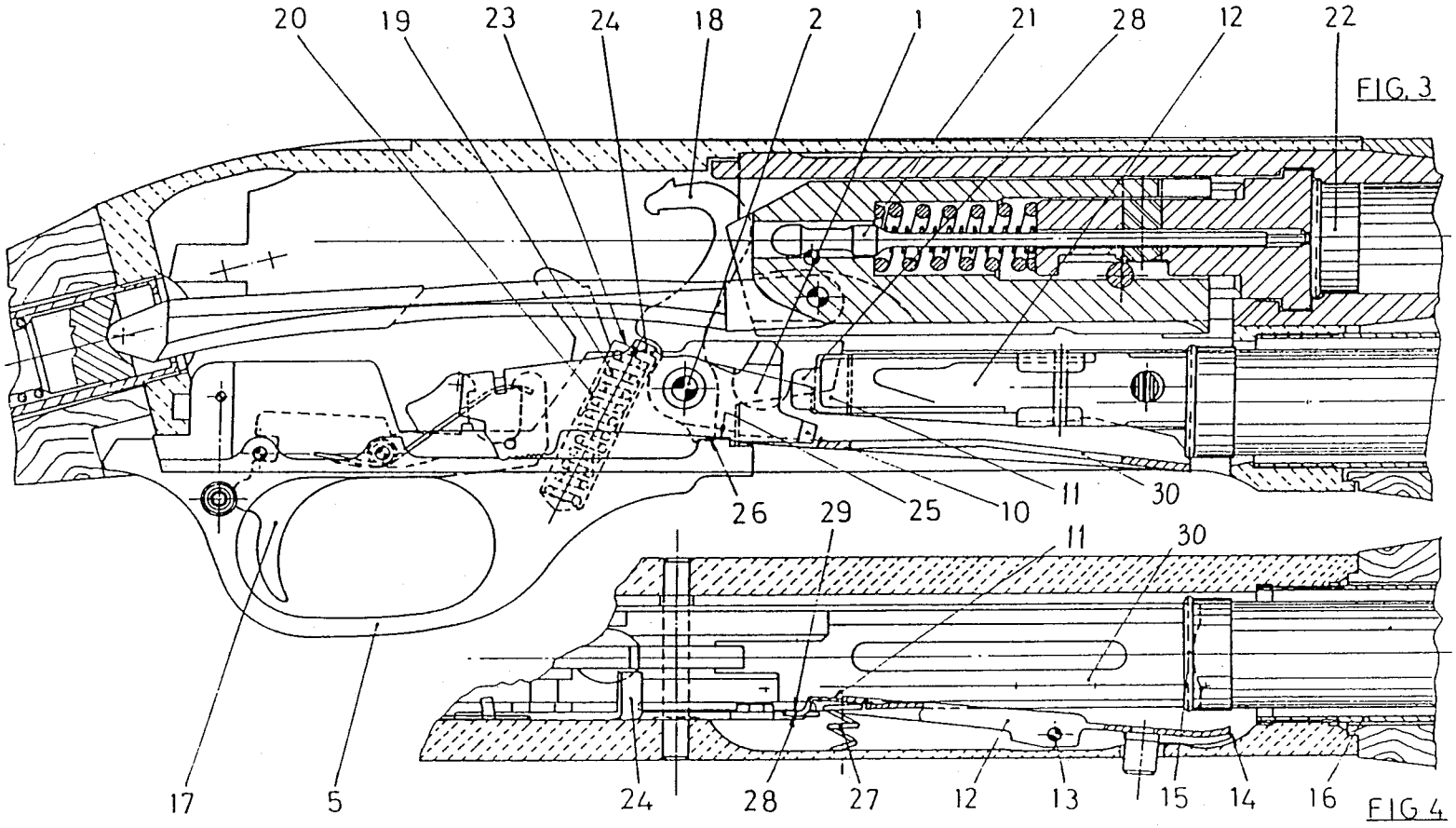
FIG. 3 is a fragmentary axial cross section of the firearm during percussion of the cartridge in the barrel with the bolt still in closure position, unarmed hammer, tubular magazine loaded and feed assembly already preset for the exit of a cartridge from the magazine.
FIG. 4 is a fragmentary transverse sectional view of the firearm in the same conditions described for FIG. 3.

Therefore (see FIG. 5), as the bolt 31 continues its backward opening stroke, the contact of the tab 36 of the cartridge descent lever 1 with the cam surface 37 of the bolt 31, although it causes a clockwise rotation about the pivot 2 of said cartridge descent lever 1 to bring it for a short ime in the position of FIG. 3, does not cause, at this stage, the second cartridge 35 to leave the magazine.

After completion of the backward opening stroke, and the consequent conventional expulsion of the case of the cartridge exploded in the barrel, the bolt 31, pushed by the spring 38 visible in FIG. 1 when the firearm was in closed position, tends to return to the same closure posittion described above.

Figures 7, 8:
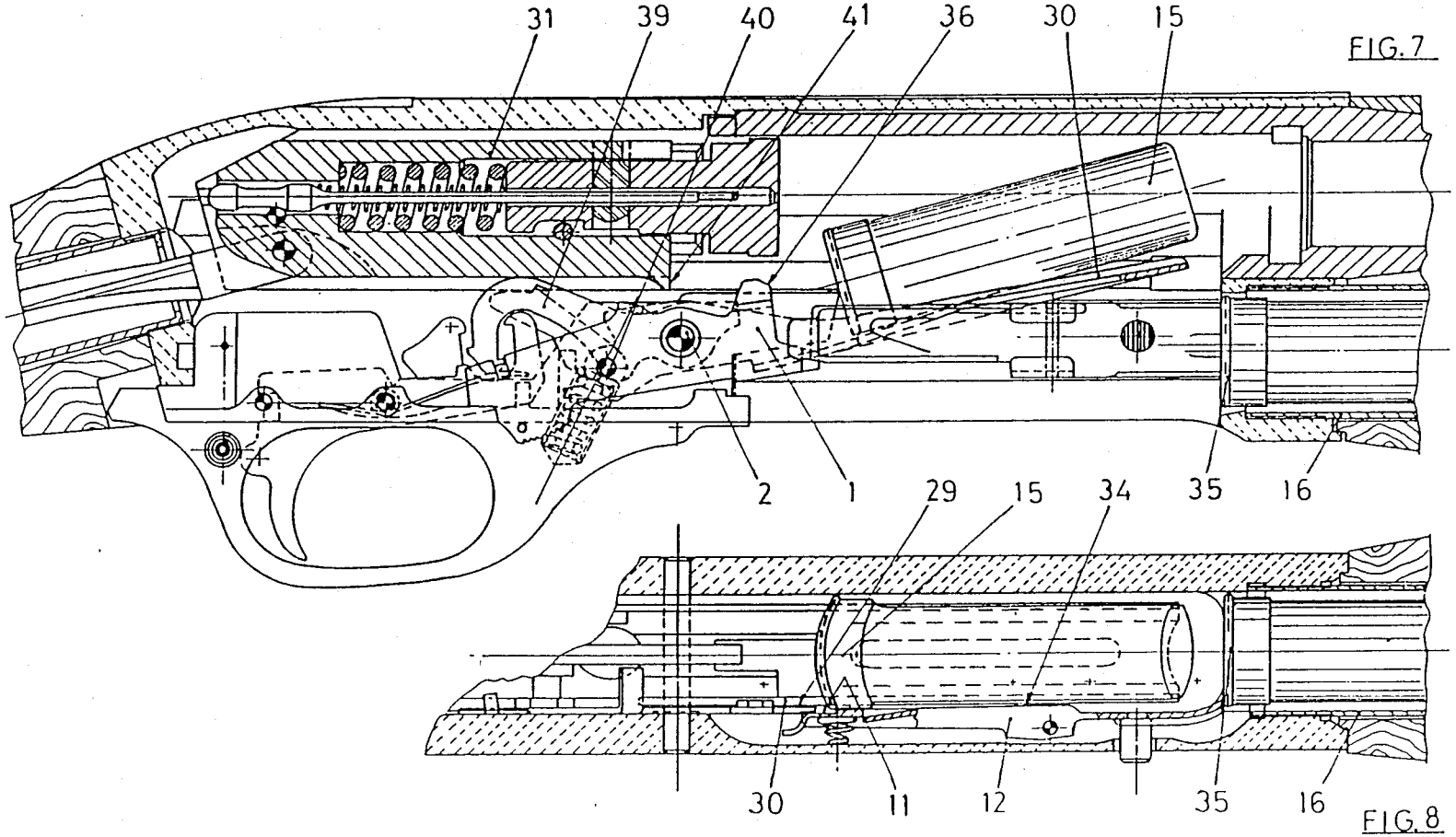
FIG. 7 is a fragmentary axial sectional view of the firearm in a stage subsequent to the preceding one with the bolt which, having completed the backward opening stroke, is returning to the closure position; the feed system raises the cartridge exited from the magazine for its introduction in the cartridge chamber of the firearm, at the same time retaining in the magazine the cartridges still contained therein.
FIG. 8 is a fragmentary transverse sectional view of the firearm in the same conditions described for FIG. 7.

As soon as it reverses its movement, the bolt 31, together with bolt stop tooth 39 pivoted to the lifter cup 30 on the pivot 40, causes, FIG. 7, according to what similarly occurs in known feed systems, the lifting of the cartridge 15 exited from the magazine 16.

During this stage (FIG. 8), the cartridge stop lever 12 prevents the exit of the second cartridge in the magazine, even when the cartridge 15 no longer rests on its flat 11, since the front plane 24 of said cartridge stop lever 12 makes contact with the side 29 of the lifter cup 30 which is moved into a raised position, such as to allow the introduction of said cartridge 15 in the barrel.

It is thereby apparent (FIG. 7) that, similarly to what has been described above for the firearm opening stage, as the bolt 31 continues its (forward) firearm closure stroke, the imminent contact of the tab 36 of the cartridge descent lever 1 with the front plane 41 of the bolt 31, although it causes a clockwise rotation about the pivot 2 of said cartridge descent lever 1 until it is momentarily in the conditions of FIG. 3, does not cause, even in this stage, the exit of the second cartridge 35 from the magazine.

Once the firearm closure step is completed (see FIG. 3) with the introduction of a new cartridge in the barrel, all the above described feed stages will be repeated by merely pulling the trigger 17, and this will be possible, round after round, until the cartridges previously inserted in the magazine tube of the firearm are exhausted.

The said effect of pulling the trigger is valid whether the firearm has semiautomatic operation (regardless of the inertial, gas intake or recoiling barrel type), or it has manual pump-type operation or convertible operation (sem-automatic and/or manual pump).

If the feed assembly is part of a firearm with manual pump operation or with "convertible" operation, (where the manual operation is also available), it is required that the cartridge passes, without pulling the trigger, from the magazine tube into the barrel, merely by opening the bolt of the firearm by means of its cocking rod.

Figures 9, 10:
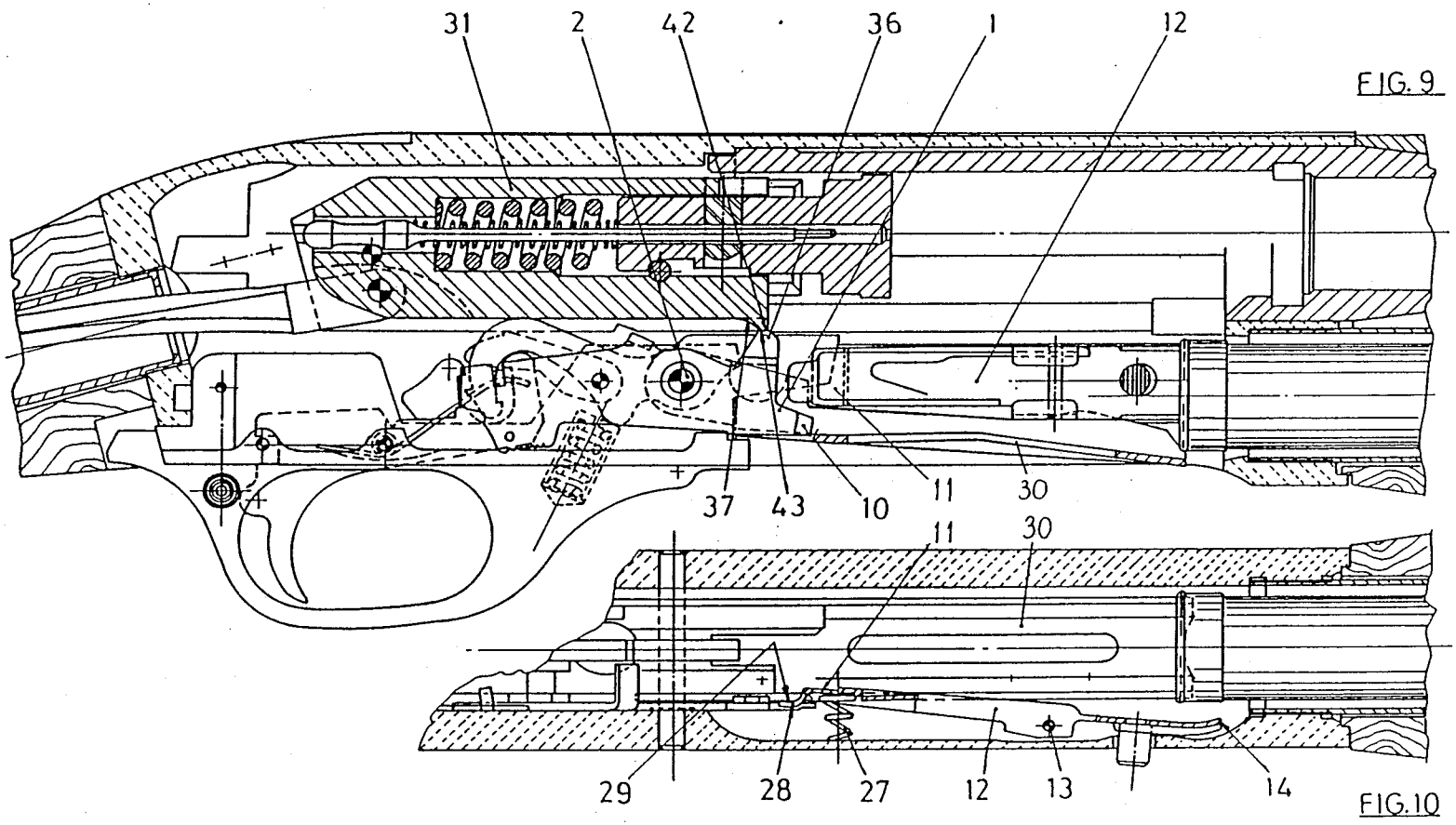
FIG. 9 is a fragmentary axial sectinal view of the firearm in an intermediate stage of its operation, in which the feed assembly is arranged for delivery of a cartridge from the magazine even when the hammer has not been uncocked (for percussion) and the bolt performs its backward opening motion after a manual actuation by the user (condition of pump-like actuation, firearm unloading or change of cartridge in barrel)
FIG. 10 is a fragmentary sectional view of the firearm in the same conditions described for FIG. 9.

In this condition (FIG. 9), the bolt 31 reaches the point in which its cam surface 37 makes contact with the tab 36 of the cartridge descent lever 1, causing its rotation about its pivot 2 until it is momentarily brought into the conditions of FIG. 3.

This momentary condition will be maintained fro the entire time required for the flat 42 of the bolt 31 to slide, relatively to its backward movement, on the flat 43 of the tab 36 of the cartridge descent lever 1.

Such short time (FIG. 9–10) is sufficient to prevent the flat 10 of the cartridge descent lever 1 from continuing to act as rest for the flat 11 of the cartridge stop lever 12.

The cartridge stop lever 12, no longer resting on the cartridge descent lever 1, rotates (FIG. 10) about its pivot 13 as an effect of the return spring 27 until its flat 28 rests on the slide 29 of the lifter cup 30. Because of this rotation, the front plane 14 of the cartridge stop lever 12 no longer prevents the cartridge from exiting from the inside of the magazine tube.

Once the cartridge has left the magazine, all the operating conditions described above in the first operating mode are repeated up to the complete return of the bolt 31 to a closure position after the introduction in the barrel of said cartridge coming from the magazine tube.

At this point it is possible to continue the feeding of the firearm from the magazine tube, manually opening and closing the bolt by means of its cocking rod or acting directly on the trigger of said firearm, to fire the round in the barrel.

In the former case the cartridges will pass from the magazine into the barrel and will immediately be expelled from the firearm up to the complete exhaustion of the cartridges in the magazine; in the latter case, the cartridges from will pass from the magazine into the barrel, will be immediately struck and will explode in the barrel and will then be expelled from the firearm until the magazine is empty.

The new cartridge feed system thus performs all its functions regardless of the type of operation of the firearm to which it can be applied.

There is, however, a further possibility of actuating the new cartridge feed system, limited to the first stage of exit of the cartridge from the magazine, when it is desired to actuate neither the trigger of the firearm nor its bolt cocking rod.

With reference to FIG. 1 of the accompanying drawings, it can be seen that the cartridge descent lever 1 is also provided with a tab 44 protruding, externally to the firearm, from the lower plane 45 of the guard 5.

If, with the finger which actuates the trigger 17, the user pushes the tab 44 of the cartridge descent lever 1 upwards, inside the plane 45 of the guard 5 a rotation of said cartridge descent lever 1 about its pivot 2 is caused, similarly to what happens both by acting on the trigger and by acting on the cocking rod of said firearm as extensively described above.

Also in this case it is thus possible to cause the exit of a cartridge from the magazine tube, and thus complete the feed cycle as described above.

To summarize, the operation of the new feed systtem is as follows:

A. IN CASE OF APPLICATION TO A FIREARM WITH SEMIAUTOMATIC OPERATION

At the moment of firing (bolt closed and cartridge in barrel), the spring of the cock, while it imparts to the cock the energy required for percussion, also causes the vertical rotation of the cartridge descent lever. This movement disengages, shortly before percussion, the cartridge descent lever from the cartridge stop lever which, by effect of its return spring, rotates clockwise, allowing thereby the exit of one cartridge from the magazine tube.

Said cartridge, in positioning itself on the lifter cup, presses against the rear part of the cartridge stop lever causing it to rotate anticlockwise and preventing thereby the exit of a second cartridge from the magazine.

The lifter cup, controlled by the bolt which, in the meantime, as an effect of the firing, has completed the retrograde opening stroke of the firearm extractingn and expelling the case in the barrel, rises automatically, while said bolt returns to a closed position, raising the cartridge in a position suitable for the insertion into the chamber.

The spring of the cock, meanwile, already recompressed by the bolt in stop position, has left the cartridge descent lever free to resume its resting position, engaging it thereby again with the cartridge stop lever which will thus finally retain the cartridges still in the magazine until a new round is fired.

B. IN CASE OF APPLICATION TO A FIREARM WITH MANUAL PUMP OPERATION

The same operating scheme described above in the cae of application to a firearm with semiautomatic operation is repeated; naturally the opening movement of the bolt will not be automatic, as an effect of the shot, but will occur upon a manual actuation of the shooter by means of the movement of the cocking rod (pump system).

If one acts repeatedly on the cocking rod withou firing the round in the barrel, excluding thereby any movement of the spring of the cock, one can obtain, similarly to what is possible with hitherto known sytems, the repeated replacement of the cartridge in the barrel until the magazine is empty.

The new cartridge descent lever, in this case, executes its rotational movement, as described in paragraph "A", by virtue of an adapted tab thereof on which the bolt acts during the retrograde opening motion obtained by means of the cocking rod (pump system).

Naturally the configuration of the new cartridge descent lever is such as to ensure the operation of the system both if the actuation for its rotation is imparted by the spring of the cock and if said actuation is imparted by the bolt.

In any case the two actuation possibilities do not interfere with one another and are in any case synchronized and compatible without the need for adjustments.

C. IN CASE OF APPLICATION TO A FIREARM WITH OPERATION CONVERTIBLE FROM SEMIAUTOMATIC TO MANUAL PUMP

Also in this case the operating possibilities described in the preceding paragaraphs "A" and "B" are repeated.

A cartridge feed assembly is thus provided essentially composed of a new cartridge descent lever which, together with a cartridge stop lever which can be made integral therewith, simply and securely selects the exit of the cartridges from the magazine without the need for preventive adjustments and regardless of the operating system of the firearm, be it semiautomatic, of the manual pump type or combined (semiautomatic and/or manual pump type), all the movements of the new cartridge descent lever being in any case synchronized and compatible with the operating system of the firearm to which it can be coupled.

The invention can be carried out in other embodiments, different from the one described, within the scope and the essential technical features of the invention itself.

The above requirements are therefore to be considered as illustrative and non-limitative; all the changes falling within the attached claims are assumed included therein.

I claim:

1. A cartridge feeding assembly for delivering cartridges from a tubular magazine into the barrel of a smoothbore firearm having a casing, a bolt slidable with respect to said casing, a cocking rod acting on said bolt, a lifter cup for the cartridge, a hammer and a trigger, and feeding assembly further comprising:

a cartridge descent lever pivoted on said casing, and having a first leg directed toward said cartridge magazine and having a nose, and an integral second leg directed away from said magazine;

a spring mounted on said casing and normally biasing said descent lever to a rest position;

a cartridge stop lever pivoted on said casing and having a nose interacting with said nose of said descent lever so that said stop lever retains a cartridge in said magazine while said descent lever is in said rest position and allows the cartridge to slide out of said magazine when said descent lever swings away from said rest position;

a first control member and a second control member provided on said descent lever;

first means operatively connecting said trigger to said first control member of said descent lever;

second means operatively connecting said bolt to said second control member;

said first means acting on said first control member to swing away said descent lever from said rest position upon acting on said trigger;

said second means acting on said second control member to swing away said descent lever from said rest position upon acting on said cocking rod.

2. A cartridge feeding assembly according to claim 1 wherein said descent lever comprises a third control member, said third control member being external to said casing, said third control member being manually operable to swing away said descent lever from its rest position without acting on either said trigger or said cocking rod.

3. A cartridge feeding assembly according to claim 2 wherein said third control member is constituted by a third tab provided on said second leg of said descent lever.

4. A cartridge feeding assembly according to claim 1 wherein said first control member is constituted by a first tab and said second control member is constituted by a second tab, said first tab being provided on said second leg of said descent lever, said second tab being provided on said first leg of said descent lever.

5. A cartridge feeding assembly according tot claim 4 wherein said third control member is constituted by a third tab provided on said second leg of said descent lever.

6. A cartridge feeding assembly according to claim 1 wherein said first means comprises an elastic means activated by said trigger, said elastic means acting upon said first control member of said descent lever and upon said hammer.

7. A cartridge feeding assembly according to claim 1 wherein said second means comprises a cam provided on said bolt.

* * * * *